US010840650B2

(12) United States Patent
Winkler et al.

(10) Patent No.: US 10,840,650 B2
(45) Date of Patent: Nov. 17, 2020

(54) PLUG SYSTEM

(71) Applicant: Rosenberger Hochfrequenztechnik GmbH & Co. KG, Fridolfing (DE)

(72) Inventors: Johannes Winkler, Taching am See (DE); Johannes Schmid, Altoetting (DE); Gunnar Armbrecht, Tittmoning (DE); Rainer Bippus, Teisendorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/497,898

(22) PCT Filed: Apr. 3, 2018

(86) PCT No.: PCT/EP2018/058491
§ 371 (c)(1),
(2) Date: Sep. 26, 2019

(87) PCT Pub. No.: WO2018/185102
PCT Pub. Date: Oct. 11, 2018

(65) Prior Publication Data

US 2020/0106219 A1 Apr. 2, 2020

(30) Foreign Application Priority Data

Apr. 4, 2017 (DE) ..... 10 2017 107 248

(51) Int. Cl.
*H01R 13/66* (2006.01)
*H01R 13/6581* (2011.01)
*H01R 29/00* (2006.01)

(52) U.S. Cl.
CPC ..... *H01R 13/6658* (2013.01); *H01R 13/6581* (2013.01); *H01R 29/00* (2013.01)

(58) Field of Classification Search
CPC ..... H01R 13/6658; H01R 13/6625; H01R 13/719; H01R 13/658; H01R 13/6592; H01R 13/6581; H01R 9/032; H01R 29/00
(Continued)

(56) References Cited

U.S. PATENT DOCUMENTS 5,314,346 A 5/1994 Ownes et al.
5,683,261 A 11/1997 Ahles et al.
(Continued)

FOREIGN PATENT DOCUMENTS

JP H01134884 A 5/1989
JP H08293363 A 11/1996
JP 2001143833 A 5/2001

OTHER PUBLICATIONS

International Search Report and Written Opinion of International Searching Authority in connection with International Application No. PCT/EP2018/058491 (10 pages).

*Primary Examiner* — Gary F Paumen
(74) *Attorney, Agent, or Firm* — Donald S. Showalter; GrayRobinson, P.A.

(57) ABSTRACT

An embodiment of a plug system having an electrical plug for connecting at least one electrical lead and having an electrical circuit. In certain embodiments, the electrical may have: at least one input-side contact which can be electrically connected to a signal conductor of the electrical lead; at least one output-side contact which can be electrically connected to an inner conductor of the plug; means for shielding which can be electrically connected to an earth conductor of the at least one electrical lead; a receptacle for the electrical circuit; and a closure element for closing an access opening of the receptacle. In some embodiments, the electrical circuit has contact points for contacting at least one input-side contact and at least one output-side contact when the electrical circuit is in the receptacle. The electrical
(Continued)

circuit may have a transmission option for transmission from at least one input-side contact to at least one output-side contact.

15 Claims, 5 Drawing Sheets

(58) Field of Classification Search
USPC ..... 439/620.21, 620.22, 620.24, 620.25, 439/607.41–607.46
See application file for complete search history.

(56) References Cited

U.S. PATENT DOCUMENTS 5,955,703 A 9/1999 Daly et al.
5,989,069 A 11/1999 Tan
6,685,505 B1 2/2004 Espenshade et al.
7,775,833 B1 8/2010 Le et al.
8,162,695 B2 * 4/2012 Zhang ..... H01R 13/717 439/620.22
9,252,552 B2 * 2/2016 Honda ..... H01S 3/2232
9,774,111 B2 * 9/2017 Liang ..... H01R 12/57
2006/0276064 A1 * 12/2006 Takimura ..... H01R 13/6585 439/108
2009/0253301 A1 * 10/2009 Chang ..... H01R 13/2442 439/620.22
2010/0062645 A1 * 3/2010 Chow ..... H01R 27/02 439/620.22
2010/0159748 A1 * 6/2010 Chang ..... H01R 13/6658 439/620.22
2011/0104933 A1 * 5/2011 Straka ..... H01R 13/6625 439/404
2012/0244752 A1 * 9/2012 Patel ..... H01R 13/6464 439/620.22
2014/0011393 A1 * 1/2014 Straka ..... H01R 13/6466 439/387
2016/0181747 A1 * 6/2016 Gao ..... H01R 24/64 439/620.21
2016/0365673 A1 12/2016 Liang et al.

* cited by examiner

PLUG SYSTEM

CROSS REFERENCE TO RELATED APPLICATIONS

This is a U.S. National Phase Entry under 35 U.S.C. § 371 of International Application No. PCT/EP2018/058491 filed Apr. 3, 2018 entitled: PLUG SYSTEM which designates the United States and at least one other country in addition to the United States and claims priority to German Patent Application No. 10 2017 107 248.9 filed Apr. 4, 2017.

STATEMENT REGARDING FEDERALLY-SPONSORED RESEARCH OR DEVELOPMENT

Not applicable.

INCORPORATION BY REFERENCE

International Application No. PCT/EP2018/058491 and German Patent Application No. 10 2017 107 248.9 are each expressly incorporated herein by reference in their entireties to form part of the present disclosure.

FIELD OF INVENTION

The invention relates to the field of plug-in electrical connectors. More particularly, the invention relates to a plug-in connector system, having an electrical plug-in connector for connection to at least one electrical line and also an electrical circuit. The invention also relates to an electrical plug-in connector and to an electrical circuit for a plug-in connector system of this kind.

BACKGROUND

Plug-in connectors for disconnecting and connecting lines have long been known and are used in various forms in electrical engineering in particular. A plug-in connector may be a plug, a socket, a coupling or an adapter. In particular, the plug-in connector can be used for connection to at least one cable and/or to at least one printed circuit board (PCB). The term "plug-in connector" used within the scope of the invention is representative of all variants.

On account of the ongoing development in digital engineering amongst other things, signal-processing systems which sometimes have to be connected to one another via cable connections and therefore plug-in connectors are becoming increasingly more complex. Therefore, additional circuit components are periodically required in order to ensure a sufficiently high data rate and signal quality of the cable connection.

Particularly for achieving high data rates, it may be necessary to take into account the installed cable lengths and, for example, to match impedances or wave resistances and/or to process, that is to say to attenuate, to amplify, to linearize or to manipulate in some other way, the signals, which are to be transmitted, in an application-specific manner.

Finally, a large variety of variants is produced in respect of the components required for signal processing, which components usually have to be individually provided by the manufacturers.

It has been found that it may be advantageous from a manufacturing point of view to integrate circuit components and, at times, entire printed circuit boards into a cable arrangement or a plug-in connection. Plug-in connectors of this kind are known, for example, from U.S. Pat. No. 7,775,833 B1 and U.S. Pat. No. 5,955,703. Systems of this kind can have an economic advantage since system components can be of identical design as a result and only the cable arrangements have to be individually matched.

Depending on the application, cable exchange can be performed in part quickly and simply in comparison to exchanging other system components. An exchange of this kind may be necessary for many reasons, for example owing to damage or a change in the system or an expansion of the system.

However, in many cases, cable exchange itself can be carried out only with difficulty. This is the case in the automotive or the aerospace industry in particular. For example, on account of limitations in terms of installation space, cables which are laid in a motor vehicle are usually accessible without a great deal of effort in respect of disassembly only in subregions, for example in the region of plug-in connections.

The production of various cable arrangements of the variety usually required is also complicated and costly.

A further problem with the known plug-in connectors is that a cable interface usually needs to be fanned out in order to be able to meet the geometric requirements of the plug-in connector interface. However, a fanned-out region of this kind is critical for the transmission of high-frequency signals in particular and can adversely affect the signal quality.

In view of the known prior art, the object of the present invention is therefore to provide an improved plug-in connector system in which adapting the circuitry is more easily possible than with the current prior art.

The plug-in connector system according to the invention has an electrical plug-in connector for connection to at least one electrical line and also an electrical circuit.

The electrical circuit preferably has at least one electrical component.

An electrical line is understood to mean any desired device for transporting or for transmitting electrical energy for data transmission and/or for supplying electrical power. The electrical line is preferably an electrical cable comprising a combination of a plurality of individual lines. In this case, an electrical cable generally has a ground conductor or external conductor and one or more signal conductors in the form of internal conductors.

However, provision may also be made within the scope of the invention for the electrical line to be an electrical line of an electrical device, of a further plug-in connector or of an electrical line on a printed circuit board, for example a microstrip line or a connection point to a microstrip line.

Analogously, the term "ground conductor" can be understood to mean any desired electrical conductor which carries a ground potential or some other reference potential.

Analogously, the term "signal conductor" can be understood to mean any desired conductor for transmitting electrical data signals and/or electrical supply signals.

For the purpose of better understanding, the invention will be described below substantially with reference to the connection to an electrical cable. This should not be understood as restrictive. A person skilled in the art is able to readily swap the terms "cable", "external conductor" and "internal conductor" for the more general terms "line", "ground conductor" and "signal conductor".

The plug-in connector can preferably have a housing for receiving the at least one electrical line, for example for receiving an electrical cable.

In a preferred embodiment, a single cable can be received by the housing in particular. For the purpose of receiving the at least one cable, it may be advantageous to provide means for sealing off and/or for strain relief of forces which act on the cable, which means have long been known from the prior art.

The housing may be an electrically conductive housing, for example composed of a metal, preferably an electrically non-conductive housing, for example composed of a plastic. A mixed form is also possible. The use of a plastic housing is usually more simple from a manufacturing point of view and can also provide advantages from an electrical point of view on account of the insulating properties, depending on the site of use.

According to the invention, the electrical plug-in connector further comprises at least one input-side contact, which can be connected to a signal conductor of the electrical line (for example a cable internal conductor of an electrical cable), and at least one output-side contact, which can be electrically connected to a plug-in connector internal conductor.

The input-side contact of the plug-in connector, to which the electrical conductor is connected or at which the at least one cable is received by the at least one internal conductor, and the output-side contact of the plug-in connector are therefore not electrically connected to one another in principle, that is to say without further measures and refinements as described below.

In a particularly preferred embodiment, the at least one input-side contact and the at least one output-side contact are physically separated from one another. The two contacts can be arranged opposite one another that is to say in a line or axis. Those ends of the input-side contacts and of the output-side contacts which face one another are preferably arranged in two planes which are situated opposite one another, preferably run parallel in relation to one another.

Provision can be made for a single-pole plug-in connector or a multipole plug-in connector to be used. That is to say, provision can be made to provide in each case one input-side contact and one output-side contact or more than one input-side contact and more than one output-side contact. Two to twenty input-side contacts, particularly preferably three to ten input-side contacts, and very particularly preferably up to four input-side contacts, are preferably provided in each case. The number of output-side contacts is preferably analogous.

Provision can also be made for the number of input-side contacts and output-side contacts to differ from one another.

Furthermore, the number of signal conductors or cable internal conductors and input-side contacts or the number of plug-in connector internal conductors and output-side contacts can also differ. For example, a plurality of signal conductors or cable internal conductors can be combined on the same input-side contact.

According to the invention, the electrical plug-in connector further has shielding means which can be electrically connected to a ground connector of the at least one electrical line (for example an external conductor of the at least one cable).

Shielding against undesired electrical or electromagnetic influences is required particularly for achieving high data rates. It has been found that it is advantageous when not only the signal line or the cable itself, but rather also the plug-in connection and the electrical components of the plug-in connection have a high electromagnetic compatibility (EMC) and therefore suitable shielding means.

According to the invention, provision is further made for the plug-in connector to have a receptacle for the electrical circuit and a closure element for closing an access opening of the receptacle.

In this case, the receptacle is preferably arranged in such a way that it physically separates the at least one input-side contact and the at least one output-side contact from one another or is located between the at least one input-side contact and the at least one output-side contact.

The electrical circuit has contact points in order to contact-connect at least one input-side contact and at least one output-side contact when the electrical circuit is inserted into the receptacle. The electrical circuit further has a transmission option from the at least one input-side contact to the at least one output-side contact. In the case of a plurality of electrical lines or in the case of a plurality of signal conductors, the transmission options can be designed individually for each line or for each signal conductor or for each contact or for each signal to be transmitted.

In a particularly preferred embodiment, the electrical circuit can be inserted between the at least one input-side contact and the at least one output-side contact in such a way that a contact point or contact points of an input-side contact area of the electrical circuit makes contact or make contact with the at least one input-side contact and a contact point or contact points of an output-side contact area of the electrical circuit (which preferably runs parallel in relation to the input-side contact area and is oriented opposite thereto) makes contact or make contact with the at least one output-side contact.

In a development of the invention, provision can be made, in particular, for the electrical circuit to be designed as a printed circuit board, preferably as a two-sided printed circuit board (with two printed circuit board layers) or as a multilayer printed circuit board with more than two printed circuit board layers, as a multichip module, as a system-in-package, as a system-on-chip and/or as an integrated circuit.

In a particularly preferred variant, the electrical circuit can be designed as a printed circuit board with one or more printed circuit board layers, wherein the printed circuit board can have, for example, conductor tracks, vias and/or electrical components, such as, for example, resistors, capacitors, inductors and/or semiconductor circuits up to complex integrated circuits or microchips or application-specific integrated circuits (ASICs).

In the present case, a printed circuit board with a plurality of layers, that is to say, for example, a "multilayer printed circuit board", can also be understood to mean a system comprising a plurality of (populated or non-populated) one-sided or two-sided printed circuit boards.

For the purpose of forming the electrical circuit, provision can also be made to arrange a plurality of microchips one above the other and/or next to one another in a common chip package in the manner of a so-called "multichip module", wherein the microchips within the chip package are connected to one another and/or to the contact points of the chip package or of the electrical circuit via so-called bonding wires—or by some other known connection technique.

Finally, the electrical circuit can also be designed as a "system-in-package", wherein one or more microchips together with at least one further electrical component (for example together with coupling capacitors) are arranged within a common chip package and connected to one another and/or to the contact points of the electrical circuit by bonding wires (or in some other way).

A so-called "system-on-chip" or a conventional microchip or a single application-specific integrated circuit can also be provided in a chip package with contact points arranged on the chip package in order to realize the electrical circuit.

For reasons of simplicity, the invention will be described below substantially using a printed circuit board as the electrical circuit. However, this should not be understood as restrictive.

The electrical circuit, in particular a multilayer printed circuit board, can preferably have a metallization on at least one surface, preferably on all outwardly facing surfaces.

The plug-in connector system according to the invention renders possible the use of a modular plug-in connector which exhibits, for example, signal-improving properties owing to the insertion of a specific electrical circuit, for example a printed circuit board with a desired electronics system. The functions of the plug-in connector can therefore be defined by various electrical circuits. In this case, the plug-in connector and the electrical line which is connected to the plug-in connector can be produced in an identical manner for a large number of applications. Only the electrical circuits have to be individually matched to the specific application variant. Furthermore, installation or mounting of the electrical circuit is possible in a simple manner. Therefore, an end user could also make a decision about the variant to be installed or make a change to the variant, for example a function extension, in a simple manner.

The disadvantage that a solution which is already installed can be used only for a defined purpose is overcome by the present invention. Virtually any type of electronics system and therefore functionality can also be installed subsequently, for example in the form of a printed circuit board.

It may be advantageous for most applications for the electrical circuit, which can be inserted into the receptacle, to be inserted only once by the manufacturer and as a result for the functionality of the plug-in connector or of the cable which is connected to it to be defined.

The plug-in connector system described can be advantageously used, in particular, in the automotive sector. In this case, components can be modified quickly and cost-effectively without intervention in the adjoining electronics system being necessary or exchange of an entire cable, a printed circuit and/or a device, for example a control device, being required.

The plug-in connector system according to the invention can also be used in the manner of an adapter or adapter plug.

Provision can also be made for the electrical circuit to be able to be used as an enabling module for expanded functions which can be purchased, for example, by an end user. The plug-in connector system can therefore be used for forming an access authorization system.

In one development of the invention, provision can be made for the electrical circuit, when it is inserted into the receptacle, to be positioned between the at least one input-side contact and the at least one output-side contact. The contacts and/or contact points can all (each) be realized with the same contact type or with different contact types in this case. Any desired combinations are possible.

In one development, provision can also be made for the contact points of the electrical circuit and/or the contacts of the plug-in connector to be designed as flat contacts and/or sliding contacts and/or solder areas (also called "pads") and/or spring contacts (for example pogo pins) and/or plug-in contacts (male or female).

Particularly when the electrical circuit is intended to be inserted into the receptacle, the mentioned embodiments of the contact points have been found to be advantageous. It goes without saying that further contact-making options are also possible, for example embodiments with contact blades and appropriate receptacles for the contact blades, and the like.

In one development, provision can further be made, when contacts of the plug-in connector are designed as spring contacts, for the relaxed length of the springs and/or the distances between the contacts to be selected in such a way that at least one input-side contact and at least one output-side contact also make contact when the electrical circuit is not inserted into the receptacle.

In this situation, it is expedient to arrange the contact pair, which is made up of an input-side contact and an output-side contact, opposite one another in a line.

Even in the case in which the electrical circuit is not inserted into the receptacle, provision can be made for the at least one input-side contact and the at least one output-side contact to make contact. Therefore, the plug-in connector system would itself be able to be used at least as a basic embodiment in this state.

Provision can also be made for there to be no contact without an inserted electrical circuit. This can be realized even when the contacts are designed as spring contacts, for example by an offset arrangement, that is to say arrangement not situated in a line, of the contacts of a contact pair.

When a multipole plug-in connector is used, provision can be made for some contacts to make contact even when an electrical circuit is not inserted and, in contrast, for other contacts to make contact only in an inserted state of the electrical circuit.

Depending on the application, it may be necessary to integrate additional electrical components, for example for signal processing, into the plug-in connector system by means of the electrical circuit.

For example, the transmission technology can be matched in an optimum manner to the transmission channel. The signal integrity can then be maintained, for example, on long lines, wherein matching of the electrical circuit to the channel length and/or to the channel type, for example the cable length and the cable type, can be provided in particular.

As an alternative or in addition, the electrical circuit can also render possible rewiring of the plug-in connector.

In one development of the invention, provision can be made for the closure element to be at least partially formed from an electrically conductive material, and for the closure element, when it closes the access opening of the receptacle, to make electrical contact with the shielding means for the plug-in connector.

A direct or indirect electrical connection of the closure element to the shielding means for the plug-in connector, or to the ground conductor of the at least one electrical line or to the external conductor of the at least one cable, can advantageously improve the shielding of the plug-in connector and of the electrical circuit, for example of a printed circuit board and also possibly further components within the plug-in connector. The electromagnetic compatibility of the plug-in connector system can therefore be increased. In this case, a contact-connection which covers as large an area as possible or is as complete as possible and therefore also has a low resistance can be advantageous.

Provision can be made for the closure element to have at least one contact spring which makes electrical contact with the shielding means for the plug-in connector when the closure element closes the access opening of the receptacle.

The use of a contact spring has been found to establish particularly reliable electrical connection. Irrespective of surface roughnesses, manufacturing tolerances and mechanical and thermal loading of the plug-in connector system during operation, a defined contact option can be provided in this way. Owing to the use of the contact spring, a large tolerance range can be compensated for and a "hole" in the shielding of the plug-in connector system can be avoided at any time.

In particular, provision can be made for the closure element to be formed from plastic with an electrically conductive attachment or (preferably completely) from metal.

A conductive attachment is understood to mean, in particular, a metal sheet or a structure which can be attached, for example clipped or adhesively bonded, to that side of the closure element which faces the inner side of the plug-in connector. In this case, the conductive attachment can preferably be of one-part design with a contact spring. Provision can also be made for a contact spring to be electrically conductively connected to the conductive attachment or to the metal of the closure element. The contact spring can preferably establish an electrically conductive connection between the shielding means for the plug-in connector and the closure element or the attachment when the closure element is inserted into the access opening.

In one development of the invention, provision can be made for the closure element to have a seal for sealing off the access opening.

A seal means, in particular, a mechanical seal against soiling and/or for protection against the ingress of liquids. Said seal may be a rubber-like or foam-like material or the like.

In one development, provision can also be made for the closure element to be fixed in a force-fitting and/or materially bonded and/or interlocking manner, preferably clamped and/or screwed and/or adhesively bonded and/or soldered, in the housing of the plug-in connector and/or in the shielding means for the plug-in connector and/or the receptacle.

The use of a simple closure element, for example in the form of a metal sheet, can be advantageous depending on the application, complexity and space requirement.

Provision can also be made for the electrical circuit, in particular a printed circuit board, to be of one-part design with the closure element. Provision can therefore be made for the electrical circuit or the printed circuit board itself to close the access opening of the receptacle after insertion of the electrical circuit or printed circuit board.

Provision can further be made for the electrical circuit to have a circuit shielding, and for at least one contact element to be provided on the shielding means for the plug-in connector and/or on the ground conductor of the at least one electrical line and/or on the closure element and/or on the electrical circuit in order to electrically contact-connect the circuit shielding to the ground conductor of the at least one electrical line when the electrical circuit is inserted into the receptacle.

Provision can optionally also be made for the circuit shielding to be electrically connected to at least one signal conductor of the at least one electrical line, in particular when a signal conductor is carrying a defined potential, for example a ground potential, which is suitable for forming a sufficiently good shielding.

A separate shielding of the electrical circuit, for example a shielding of the printed circuit board in addition to the shielding by the shielding means of the plug-in connector, can be advantageous in order to achieve even better electromagnetic compatibility of the plug-in connector system. Even if an electromagnetic leak of the plug-in connector which surrounds the electrical circuit should occur, for example on account of damage, the sensitive electronics system, for example the electronics system of a printed circuit board, would nevertheless be shielded in this way.

In principle, it is preferred to protect the plug-in connector system against electromagnetic interference phenomena in a redundant manner using the shielding means (optionally including the shielding by the closure element) and the contact-connection of the circuit shielding.

When the electrical circuit is designed as a multilayer printed circuit board, the multilayer printed circuit board can have, for example, an encircling surface and edge metallization composed of metal, preferably copper, for forming the circuit shielding. The encircling metallization constitutes a particularly simple and effective way of shielding the multilayer printed circuit board against electromagnetic radiation. In this case, provision is made to cut out the contact points from the continuous metallization, so that said contact points are not in conductive connection with the circuit shielding.

In one development of the invention, provision can be made for at least one electrical component to be integrated into the electrical circuit, in particular into the printed circuit board, wherein a thermally conductive layer is formed immediately adjacent to at least one of the electrical components, and wherein the thermally conductive layer has an electrically insulating polymer carrier material, in particular synthetic resin and/or epoxy resin, and further comprises aluminum oxide and/or boron nitride.

A thermally conductive layer can be provided for cooling electrical components particularly when using a two-sided printed circuit board or a multilayer printed circuit board with more than two printed circuit board layers, that is to say primarily with a sandwich-like construction. In particular, provision can be made for a thermally conductive layer of this kind to be arranged between two printed circuit boards. The thermally conductive layer can be, for example, of foam-like design.

Foams are artificially produced substances with a cellular structure and a low density. Virtually all plastics are suitable for foaming. Foam-like thermally conductive layers can therefore be processed in a particularly simple manner in a multilayer printed circuit board, on a printed circuit board and in/on any desired electrical circuit and have a favorable effect on the material consumption of the carrier material.

Synthetic resin provides good electrical insulation and can be further processed in such a way that the thermal conductivity is increased. Furthermore, synthetic resin is a cost-effective material which can be applied to an electrical circuit, for example to a printed circuit board with electrical components, using a small number of process steps.

Owing to the combination of synthetic resin and aluminum oxide or boron nitride, a particularly positive compromise can be made between the desired properties "low electrical conductivity" and "high thermal conductivity". A combination which contains synthetic resin and aluminum oxide and boron nitride is also suitable.

A combination of epoxy resin and aluminum oxide or boron nitride is likewise suitable. A combination which contains epoxy resin and aluminum oxide and boron nitride is likewise suitable.

In the simplest embodiment, the electrical circuit can be designed as a printed circuit board and have only conductor tracks and/or vias, as a result of which the printed circuit board can be used only for contact-connecting the input-side contacts and the output-side contacts. In this case, different wiring or pinning of the plug-in connector can be performed, depending on the design of the printed circuit board. For example, the plug-in connector can be changed over from a standard design to a so-called "crossover" design by way of only the printed circuit board being exchanged.

Furthermore, provision can be made to influence the signals, which are transmitted by the plug-in connector, using electrical components. For example, networks consisting of resistors and/or capacitors and/or coils can be constructed in order to specially match the signal or signals to be transmitted to the requirements of the system to be used.

Active electrical circuits can also be provided.

In particular, active and/or passive components of the electrical circuit can be provided for impedance-controlled line guidance.

The electrical components used can also be semiconductor components such as transistors, in particular metal oxide semiconductor field-effect transistors (MOSFETs) or bipolar transistors.

Amplifiers and/or equalizers can be implemented in the electrical circuit in a particularly advantageous manner.

The printed circuit board or the electrical circuit can also comprise programmable components such as microprocessors or programmable circuits, such as FPGAs ("Field Programmable Gate Arrays").

The electrical circuit can be designed to identify a cable length of a connected cable and to automatically adapt the signal strength and impedance on account of the identified cable length.

In particular, the voltage level and/or wave resistances can be compensated for. Provision can also be made to change the frequency of a transmitted signal and/or to linearize or suppress interference in transmitted signals.

The electrical circuit, in particular the printed circuit board, can have any desired geometry, in particular of the contact areas. The electrical circuit or the printed circuit board preferably has rectangular or round contact areas.

A contact area is understood to mean the areas of the printed circuit board which have the contact points.

In particular, provision can be made for the plug-in connector to be designed for transmitting electrical signals in line with a USB standard, in particular for use in a motor vehicle.

In this case, provision can be made to use, in particular, USB 1.0 or USB 1.1 or USB 2.0 or USB 3.0 or any other, even higher standard.

The plug-in connector system can be used, in principle, for transmitting data and/or electrical supply signals.

The receptacle for the electrical circuit can have a mechanical encoding arrangement in such a way that only correspondingly mechanically coded electrical circuits, in particular printed circuit boards, can be used and/or in such a way that the electrical circuit, that is to say a printed circuit board for example, can be inserted only with one orientation.

A plurality of electrical circuits can also be provided in the plug-in connector.

The plug-in connector system can also have a plurality of receptacles for receiving electrical circuits.

In a particular development of the invention, provision can be made for the electrical circuit to have an input-side interface with at least one input-side contact point in order to connect the at least one signal conductor of the at least one electrical line, wherein the electrical circuit has an output-side interface with at least one output-side contact point, and wherein the transmission option is set up, in particular, at least for impedance control between the input-side interface and the output-side interface, wherein the configuration of the input-side interface differs from the configuration of the output-side interface.

Provision can be made for the number of input-side contact points and output-side contact points to differ from one another.

A differing configuration of the interfaces can be realized, in particular, by the respective arrangement of the contact points relative to one another, for example a respective center-to-center distance ("pitch"), the geometric shaping of the interfaces or the contact points, the manner of contact-connection and/or the contact material.

In a refinement of the invention, provision can be made for the input-side interface and the output-side interface of the electrical circuit to each form a contact area, which contact areas run or are arranged orthogonally in relation to the longitudinal axis of the plug-in connector.

The longitudinal axis of the plug-in connector is preferably also the plug-in direction of the plug-in connector for connection to a second plug-in connector. The longitudinal axis can further run along a supply axis of the electrical line. However, the supply of the electrical line can also take place at any desired angle, in particular at a right angle, in relation to the longitudinal axis.

Since the contact areas of the two interfaces run orthogonally in relation to the longitudinal axis of the plug-in connector, the contact areas can be particularly easily connected to the at least one signal conductor of the at least one electrical line and at least one plug-in connector internal conductor of the plug-in connector. In this case, the electrical connection can also provide a particularly high transmission quality, and this can be advantageous for high-frequency technology in particular.

Optionally, provision can be made for the electrical plug-in connector to be of two-part design, wherein the receptacle for the electrical circuit is arranged on a first part of the plug-in connector or a second part of the plug-in connector, and wherein the first part of the plug-in connector can be connected to the second part of the plug-in connector in a materially bonded, interlocking and/or force-fitting manner. The two parts of the plug-in connector are preferably clipped to one another.

The exchange element in order to exchange the electronics system or the functionality of the plug-in connector can therefore be an electrical circuit and/or a part of the plug-in connector with an electrical circuit.

A two-part design of the plug-in connector can be advantageous, in particular as an alternative to insertion of the electrical circuit, since it is possible to easily exchange the electrical circuit by exchanging a part, for example the first part, of the plug-in connector in this case too. The first part of the plug-in connector may be the part of the plug-in connector for connection to the electrical line, or the part of the plug-in connector for making contact with a second plug-in connector.

The two parts of the plug-in connector can be pushed and/or plugged one onto the other and/or one into the other.

Provision can also be made for the receptacle for the electrical circuit to be arranged on the first part or the second part of the plug-in connector in such a way that the electrical circuit is positioned between the first part of the plug-in connector and the second part of the plug-in connector when the two parts of the plug-in connector are connected to one another.

As an alternative, the receptacle of the electrical circuit can also be arranged within a part, for example the first part, of the plug-in connector in such a way that said electrical circuit is not located at the connection point with the second part of the plug-in connector. However, the receptacle of the electrical circuit is preferably arranged at the front or at the end side of the first part of the plug-in connector, as a result of which electrical contact can be made with the other part of the plug-in connector in a particularly simple manner.

In one refinement of the invention, the electrical circuit can also be split between the two parts. For example, the electrical circuit can be of two-part design, wherein, in particular, a first part of the electrical circuit can be received in the first part of the plug-in connector and a second part of the electrical circuit can be received in the second part of the plug-in connector.

In one refinement, provision can be made for the input-side contact points of the input-side interface to have a first pitch and the output-side contact points of the output-side interface to have a second pitch.

The invention can then advantageously be used to avoid a conventional fanned-out region within a plug-in connector and in order to adapt the input-side interface and the output-side interface in an impedance-controlled manner. For example, a narrow cable interface can be fanned out to form a wider plug interface in this way.

The fanned-out regions known from the prior art can, as is known, cause points of interference in the transmission path, this being disadvantageous particularly for the transmission of high-frequency signals. Owing to the electrical circuit according to the invention, the situation of the two interfaces having the same impedance can be achieved in a simple manner. To this end, for example, a printed circuit board can be provided, the microstrip lines and vias and optionally further electrical components of which compensate for the capacitive behavior of the transition from the respective internal conductors or signal conductors. Therefore, a reflection-free change in pitch can be provided by the circuit according to the invention.

In one refinement of the invention, provision can also be made for the input-side interface to be designed in line with a first plug-in connector standard and the output-side interface to be designed in line with a second plug-in connector standard.

A plug-in connector standard means a basic design of a plug-in connector, in particular an interface of the plug-in connector. Said plug-in connector standard may be standardized forms (for example a standardized RJ plug-in connection) or in-house developments or individual forms.

Owing to the electrical circuit according to the invention, a transition which is suitable in an optimum manner for high-frequency technology can nevertheless be provided even given plug-in connector standards which differ from one another between the two interfaces. The differences between the interfaces, which differences would have a negative effect on the signal transmission in principle, such as different line lengths, center-to-center distances (pitch) or a relative positioning of the contact points or of the contacts, geometry or size of the individual contact points or contacts and type of material of the individual contact points or contacts in particular, can be electrically compensated for or adapted by an appropriately selected electrical circuit.

In one refinement of the invention, provision can be made, in particular, for the transmission option to be set up in order to provide reflection-free signal transmission between the at least one electrical line and a second electrical plug-in connector and/or the at least one electrical line and one of the two parts of the plug-in connector and/or at least between the input-side interface and the output-side interface.

If the design and supply of the electrical line and of the corresponding second plug-in connector are known, the electrical circuit can therefore be designed in an optimal manner in order to ensure high-frequency signal transmission.

In one refinement, provision can also be made for the at least one signal conductor to be designed as a constituent part of a further printed circuit board and for the at least one signal conductor of the further printed circuit board to be connected to the at least one input-side contact point via at least one contact line.

For example, when the plug-in connector is designed as a printed circuit board plug-in connector and therefore is not intended to be connected to a cable, but rather to a further printed circuit board, on the input side, appropriate contact lines, which can be soldered on or in the further printed circuit board for example, can be used. The contact lines can be provided, in particular, for making contact with the signal conductors of electrical lines of the further printed circuit board, but also for making contact with a ground conductor of the further printed circuit board.

In one refinement of the invention, provision can be made for the transmission option to be set up in order to match different signal propagation times between the signal conductors of the further printed circuit board and the input-side contact points to one another, in particular on the basis of different lengths of the contact lines.

Depending on the connection of the electrical line and, in particular, when using a plug-in connector which is designed as a printed circuit board plug-in connector of angled design, different signal propagation times can be produced due to the different lengths of the contact lines, and this can have an interfering effect particularly when transmitting high-frequency signals. Owing to the use of an electrical circuit of appropriate design, for example owing to compensation with the abovementioned microstrip lines of a printed circuit board, this problem can be solved in a relatively simple manner.

Exemplary embodiments of the invention will be described in more detail below with reference to the drawings.

The figures of the drawings show preferred exemplary embodiments in which individual features of the present invention are illustrated in combination with one another. Features of one exemplary embodiment can also be implemented in a manner detached from the other features of the same exemplary embodiment and can accordingly be readily combined by a person skilled in the art with features of other exemplary embodiments to form further expedient combinations and subcombinations.

BRIEF DESCRIPTION OF THE DRAWINGS

Functionally identical elements are provided with the same reference symbols in the figures of the drawings, in which.

DETAILED DESCRIPTION OF PREFERRED EMBODIMENTS

Figure 1:
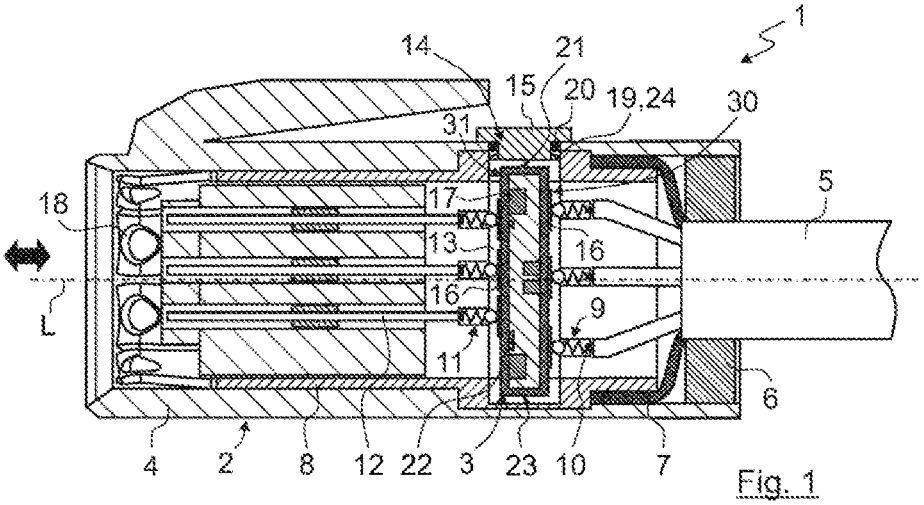
FIG. 1 schematically shows a plug-in connector system according to the invention with an electrical plug-in connector and an inserted electrical circuit in a design as a printed circuit board and also with a closure element which closes an access opening to a receptacle for the printed circuit board.

FIG. 1 illustrates a section through a plug-in connector system 1. The plug-in connector system 1 has an electrical plug-in connector 2 and an electrical circuit 3 which is designed as a printed circuit board 3 in the exemplary embodiment. The plug-in connector 2 further has a longitudinal axis L which runs along an insertion direction, indicated by a double-headed arrow in the FIG. 1.

Instead of the printed circuit board 3, any desired electrical circuit can be provided in principle, for example in the form of a multichip module, a system-in-package, a system-on-chip and/or any desired integrated circuit, that is to say, for example, even an individual microchip or ASIC. For reasons of simplification, the invention will be described with reference to a printed circuit board 3 in the exemplary embodiment, but this can be understood to be a "black box" for any desired electrical circuit.

The plug-in connector 2 has a housing 4 which is formed from a non-conductive material, for example from a plastic, in the present exemplary embodiment. The housing 4 serves, amongst other things, to receive an electrical line 5 which is designed in the exemplary embodiment as cable 5 which is held in the housing 4 of the plug-in connector 2 by means of a holding device 6. The cable 5 is an electrically shielded cable 5 with a ground conductor which is designed as an external conductor 7, in particular as a shielding braid 7, which is electrically conductively connected to a shielding means 8 for the plug-in connector 2. The external conductor 7 carries a defined electrical potential, in particular a ground potential, which is suitable for forming a shielding. The shielding braid 7 is clamped between the shielding means 8 and the housing 4 of the plug-in connector 2. The shielding means 8 preferably runs completely around the inner regions of the plug-in connector 2 in order to fully electromagnetically shield the plug-in connector 2.

As can be seen in FIG. 1, signal conductors 10, which are designed as cable internal conductors 10 of the cable 5 in the exemplary embodiment, are electrically connected at their ends which face the printed circuit board 3 to input-side contacts 9. The plug-in connector 2 has output-side contacts 11 which are electrically connected to plug-in connector internal conductors 12. In the exemplary embodiment, three contacts 9, 11 are provided in each case. The number can be arbitrary in the present case.

The plug-in connector 2 has a receptacle 13 for the printed circuit board 3, which receptacle is designed as a slot-like recess 13 between the input-side contacts 9 and the output-side contacts 11. The receptacle 13 has an access opening 14 through which the printed circuit board 3 can be inserted. A closure element 15 is provided for closing the access opening 14.

The printed circuit board 3 has contact points 16 which, in the present case, are designed as flat contacts 16 or solder areas and, when the printed circuit board 3 is in the inserted situation (as illustrated), make contact with the input-side contacts 9 and the output-side contacts 11.

In this case, the inserted printed circuit board 3 is positioned between the input-side contacts 9 and the output-side contacts 11. In order to ensure a robust and particularly reliable contact-connection and also simple insertion and removal of the printed circuit board 3, the contacts 9, 11 of the plug-in connector 2 are embodied as spring contacts 9, 11 in the present case. Owing to the use of the spring contacts 9, 11, a large tolerance range can be compensated for and the printed circuit board 3 can be inserted in a simple manner at the same time.

The printed circuit board 3 has conductor tracks, vias (not illustrated here) and electrical components 17. An individual transmission option from the input-side contacts 9 to the output-side contacts 11 can be ensured in this way. The transmission options are manifold. Therefore, for example, signal amplification operations, impedance matching operations, linearization operations through to automatic compensation with respect to the currently installed cable length and programmable circuits can be provided. Provision can also be made for the printed circuit board 3 to have only conductor tracks and/or vias, this rendering possible variable and rapidly exchangeable pinning or rewiring of the plug-in connector 2.

In the exemplary embodiment, the housing 4 of the plug-in connector 2 optionally has a mechanical encoding arrangement by way of which the plug-in connector 2, which is embodied as a plug in the present case, can be inserted, for example, into a socket (not illustrated). In principle, the plug-in connector 2 can be a plug, a socket, a coupling or an adapter. In particular, the plug-in connector 2 can also be used as a printed circuit board plug-in connector or can be received in a device housing. For further contact-connection, the plug-in connector 2 can have contact sleeves 18, which are electrically connected to the plug-in connector internal conductors 12, in its front region.

The closure element 15 is preferably formed substantially from plastic or from a non-conductive material and has an electrically conductive attachment 19 in the form of a contact spring attachment 19. In this case, the attachment 19 makes electrical contact with the shielding means 8 of the plug-in connector 2 and therefore ensures a closed electromagnetic shielding. The closure element 15 comprises a seal 20 for mechanically sealing off the access opening 14.

Furthermore, a contact element 21 is provided on the closure element 15, which contact element, in the manner of an additional contact spring, electrically connects the electrically conductive attachment 19 of the closure element 15 to a circuit shielding, in the present case a printed circuit board shielding 22 in the form of a metallized surface of the printed circuit board 3. Furthermore, a further contact element 23, which is embodied in a similar manner and additionally makes contact with the printed circuit board shielding 22 of the printed circuit board 3, is provided at the lower end of the receptacle 13. Electrical contact-connection ideally on all sides and over a large surface area of the shieldings 8, 19, 22 is advantageous in principle.

It goes without saying that one contact element or all of the contact elements 21, 23 can also be provided on the printed circuit board 3 or on the printed circuit board shielding 22.

Furthermore, a printed circuit board shielding 22 can also be realized without an electrical contact-connection to the attachment 19 necessarily being provided by means of the contact element.

The printed circuit board 3, and in particular its sectioned construction, is illustrated merely by way of example and in a highly abstract manner. The printed circuit board 3 can be a one-sided printed circuit board, a two-sided printed circuit board or a multilayer printed circuit board 3 with more than two printed circuit board layers. A printed circuit board 3 with two printed circuit board layers 26 is illustrated on an enlarged scale in FIG. 11 which will be described later.

The illustrated plug-in connector system 1 can advantageously be set up for transmitting electrical signals in line with a USB standard.

FIG. 2 once again illustrates the plug-in connector system 1 described in FIG. 1, wherein the printed circuit board 3 has been removed. Furthermore, the closure element 15 is not inserted into the access opening 14. In the exemplary embodiment of FIGS. 1 and 2, provision is made for the input-side contacts 9 and the output-side contacts 11 to not be in electrical contact when the printed circuit board 3 is removed. This is a solution which is preferred in respect of construction since it is easy to realize an arrangement of this kind. It may also be advantageous to implement reliable DC-isolation of electrical circuits within the plug-in connector 2 by removing the printed circuit board 3. The provision of a printed circuit board 3 which ensures only reliable DC-isolation between some or all of the contacts 9, 11 can also be understood to lie within the meaning of the invention. Accordingly, the printed circuit board 3 would have a transmission option or a transmission function of zero between at least one input-side contact 9 and at least one output-side contact 11. The printed circuit board 3 can therefore also serve as a securing element—either in the inserted or removed state depending on the embodiment.

In one embodiment, provision can also be made for the relaxed length of the springs, when the contacts 9, 11 are designed as springs, or the distances between the contacts 9, 11 to be selected in such a way that the input-side contacts 9 and the output-side contacts 11 make contact with one another even when a printed circuit board 3 is not inserted.

Figure 2:
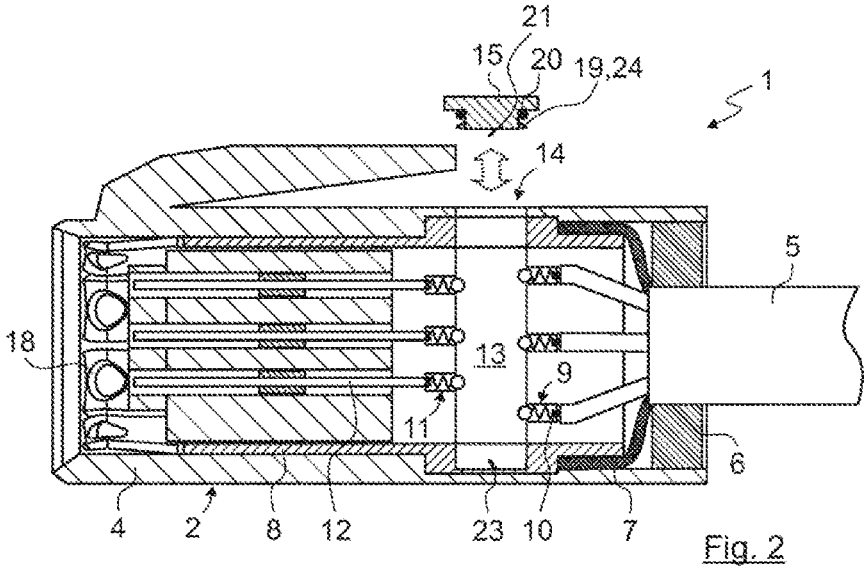
FIG. 2 schematically shows the plug-in connector system of FIG. 1 without the printed circuit board and with a raised closure element.
Figure 3:
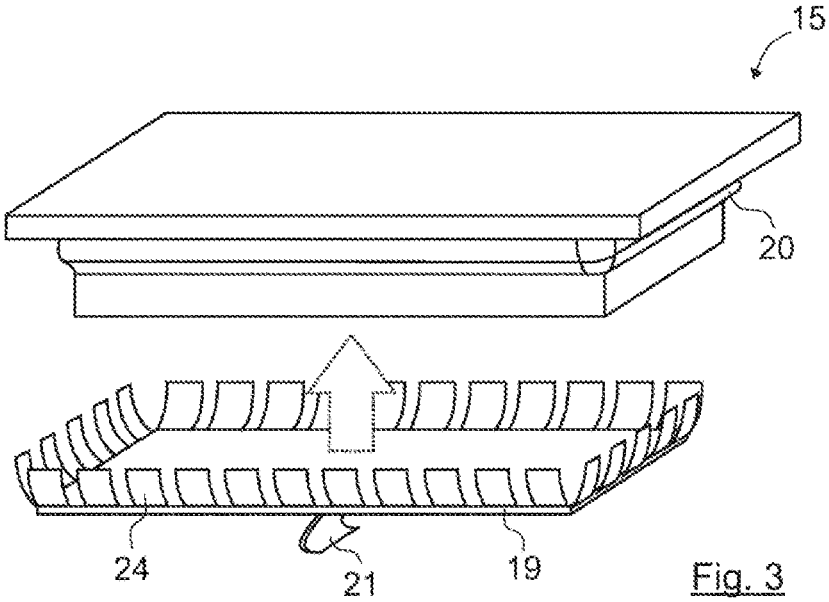
FIG. 3 schematically shows a three-dimensional illustration of the closure element of FIGS. 1 and 2 with a seal and an electrically conductive attachment.

FIG. 3 shows the closure element 15 of FIGS. 1 and 2 on an enlarged scale and in a three-dimensional illustration. In this case, the closure element 15 is formed substantially from a non-conductive material and comprises the above-described seal 20. In order to ensure adequate electromagnetic shielding, the conductive attachment 19 is preferably formed from a metal sheet and pushed or mounted onto the closure element 15. Lateral contact springs 24 are provided in this case, as a result of which reliable electrical contact-connection to the external conductor 7 of the cable 5 or to the shielding means 8 for the plug-in connector 2 can be ensured even when large tolerances are to be compensated for.

In this preferred embodiment, the contact springs 24 are preferably arranged in a manner annularly encircling the closure element 15. However, in a simplified design, a single contact-connection or a single contact spring 24 can also suffice.

Figure 4:
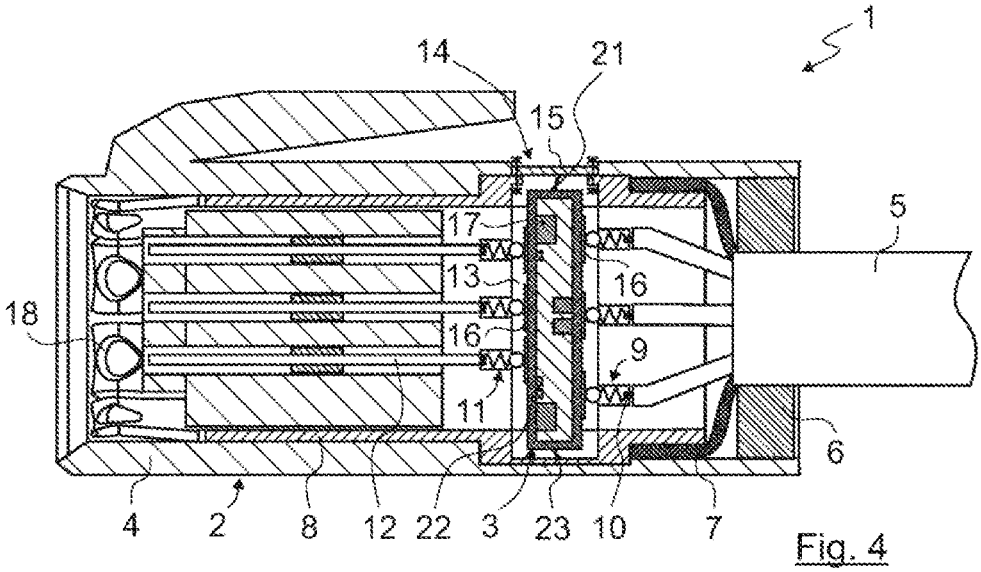
FIG. 4 schematically shows a plug-in connector system according to the invention in line with a second embodiment with a fixed closure element.

FIG. 4 illustrates a second embodiment of a plug-in connector system 1 according to the invention. Features which have already been described in a preceding exemplary embodiment are not explained in detail once again below. This applies to all of the following FIGS.

The exemplary embodiment shown in FIG. 4 differs from the previous exemplary embodiment of FIGS. 1 and 2 substantially in that the closure element 15 is formed in a simplified design as a sheet metal element or entirely of metal. The closure element 15 is connected to the shielding means 8 of the plug-in connector 2 in an interlocking and force-fitting manner by, for example, a screw connection. The closure element 15 is preferably arranged in a recessed manner in the inserted state in the housing 4 of the plug-in connector 2. As an alternative, a coplanar design or a design in which the closure element 15 protrudes out of the housing 4 (cf, for example, FIG. 1) is also possible.

Figure 5:
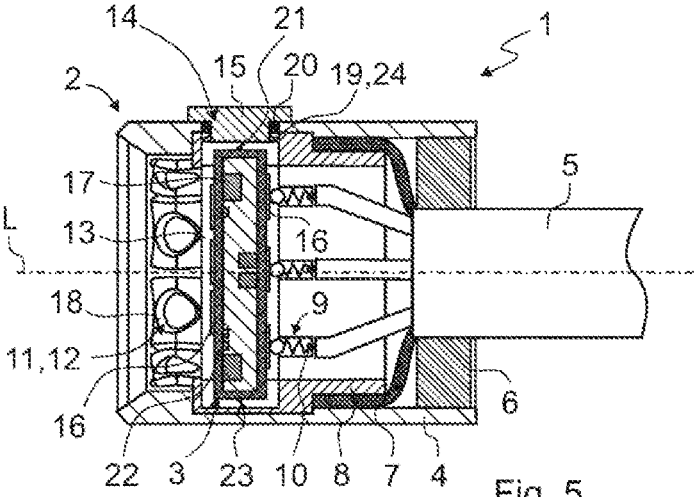
FIG. 5 schematically shows a plug-in connector system according to the invention in line with a third embodiment.

FIG. 5 shows a third exemplary embodiment of a plug-in connector system 1 according to the invention. In this case, the plug-in connector 2 is designed as a coupling. In terms of design, the contact sleeve or the contact sleeves 18 of the front region of the plug-in connector 2 is or are arranged in relation to the printed circuit board 3 in such a way that a corresponding plug is able to make direct contact on the output-side contact points 16' of the printed circuit board 3. In this case, the output-side contact 11 is formed by the corresponding plug which can be considered to be a constituent part of the present plug-in connector system 1. As an alternative, provision can also be made for the corresponding plug to make contact on the at least one output-side contact 11 of the plug-in connector 2. In this case, the output-side contacts 11 and the plug-in connector internal conductor 12 would be of one-part design with the contact sleeves 18.

Figure 6:
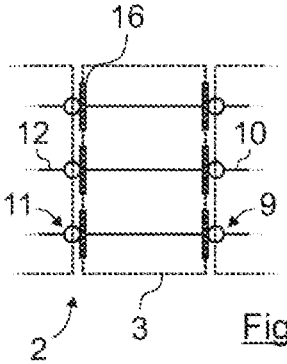
FIG. 6 schematically shows an example of a first circuit diagram of a plug-in connector according to the invention.
Figure 7:
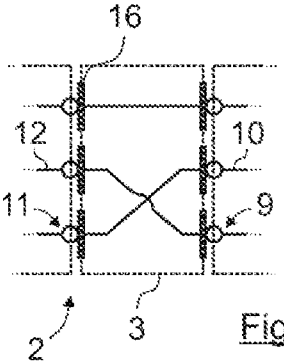
FIG. 7 schematically shows an example of a second circuit diagram of a plug-in connector according to the invention.
Figure 8:
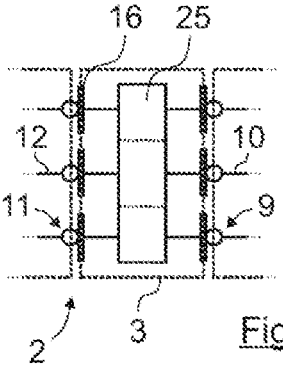
FIG. 8 schematically shows an example of a third circuit diagram of a plug-in connector according to the invention.

FIGS. 6 to 8 illustrate simplified circuit diagrams in order to illustrate three exemplary variants of the plug-in connector system 1 or in order to show examples of the different transmission options from the at least one input-side contact 9 to the at least one output-side contact 11. In this case, the input-side contact 9 of the plug-in connector 2 with the cable internal conductors 10 and the output-side contact 11 of the plug-in connector 2 with the plug-in connector internal conductors 12 and also the printed circuit board 3 are illustrated in each case. The electrical contact-connection of the contacts 9, 11 of the plug-in connector 2 and of the contact points 16 of the printed circuit board 3 are depicted only highly schematically.

In the exemplary embodiment of FIG. 6, the printed circuit board 3 functions merely to pass on or to directly contact-connect the cable internal conductors 10 to the plug-in connector internal conductors 12. To this end, the printed circuit board 3 can have only vias in the simplest case. The printed circuit board 3 and the transmission option then function as a so-called "dummy" element.

FIG. 7 illustrates a design similar to FIG. 6, in which the printed circuit board 3 once again serves only for contact-connection between the cable internal conductors 10 and the plug-in connector internal conductors 12, without further influencing the signals. However, this embodiment is concerned with a "crossover" connection, that is to say a cross-connection of signals and therefore pinning of a plug-in connector which differs from FIG. 6.

Therefore, the plug-in connection 2 can be functionally changed by exchanging the printed circuit boards 3.

FIG. 8 shows a further exemplary embodiment in which an electronics system 25—illustrated as a "black box"—of the printed circuit board 3 electrically influences one or more or all of the signals when they are passed on from the input-side contacts 9 to the output-side contacts 11.

The invention can also be used in order to avoid or to replace a conventional fanned-out region within a plug-in connector or in order to adapt an input-side interface 30 and an output-side interface 31 in an impedance-controlled manner. The so-called pitch, that is to say a center-to-center distance of the contacts 9, 11 or contact points 16, usually has to be modified within a plug-in connector. In this case, the cable internal conductors 10 are frequently fanned out, that is to say the pitch is widened, in order to achieve the correct size ratios for the plug-in connection. A fanning-out operation of this kind can be clearly seen in FIGS. 1, 2, 4 and 5.

The cable internal conductors 10 are usually fanned out such that their ends assume a position in such a way that a corresponding end of a plug-in connector internal conductor 12 is assigned to each end of a cable internal conductor 10 and the ends which are assigned to one another run coaxially in relation to one another.

In principle, any desired unbraiding options of the input-side and output-side interfaces 30, 31 are possible. Any desired pin assignments or plug-in connector standards can be adapted using the electrical circuit or printed circuit board 3, wherein impedance control by appropriate circuit components of the electrical circuit or of the printed circuit board 3 is possible at the same time. For example, a changeover can be made from a type of transmission or "stranding" with a star quad to a parallel type of transmission ("parallel pair").

Figure 9:
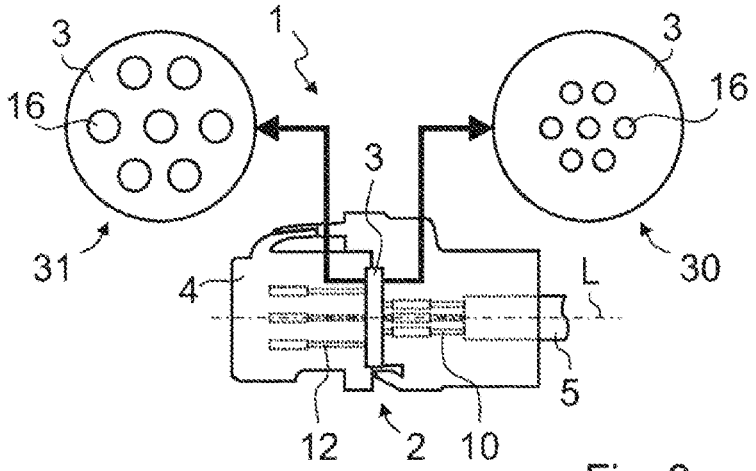
FIG. 9 schematically shows an illustration of a change in pitch between an input-side interface and an output-side interface of a plug-in connector.

FIG. 9 shows a further example of interfaces 30, 31 which are different on the input side and on the output side and each have a different pitch. The printed circuit board 3, which can have for example round contact areas as illustrated, constitutes a type of adapter which renders possible ideally adapted transmission from an input-side interface 30, in the present case a narrow cable interface, to an output-side interface 31, in the present case a wider plug interface. Therefore, the output-side interface 31 has larger distances between the individual cores or plug-in connector internal conductors 12 in the present case. A transition of this kind is normally achieved with a fanned-out region in practice, as already mentioned, but this causes points of interference in the transmission path. However, owing to the use of a suitable electrical circuit or printed circuit board 3, the two interfaces 30, 31 can have the same impedance (for example 90 Ohms differential).

For example, a printed circuit board 3 can be provided, wherein direct contact can initially be made with the printed circuit board 3 from both sides with the respective interface dimensions. A suitable design of the microstrip lines and vias of the printed circuit board 3 can then compensate for the capacitive behavior of the transition from the respective internal conductors 10, 12 to the printed circuit board 3. A reflection-free change in pitch is preferably provided.

Figure 10:
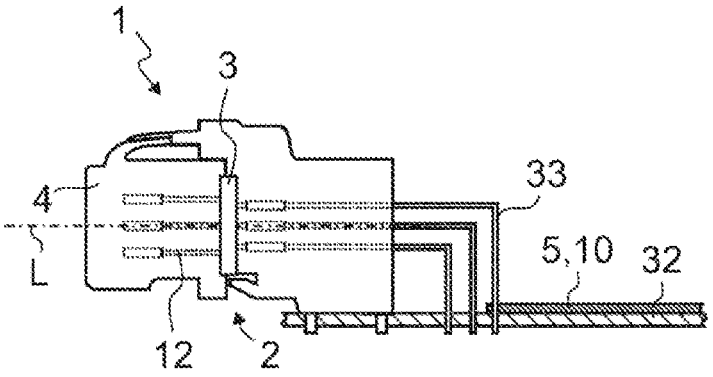
FIG. 10 schematically shows a plug-in connector designed as a printed circuit board plug-in connector.

The receptacle 13 for the printed circuit board 3 is not illustrated in FIGS. 9 and 10 for reasons of simplicity. However, the printed circuit board 3 can be inserted into the plug-in connector 2 as described above.

FIG. 10 illustrates the plug-in connector 2 of FIG. 9 as a printed circuit board plug-in connector. As illustrated, the plug-in connector 2 is not connected to a cable 5, but rather to a further printed circuit board 32, on the input side. In this case, a plurality of electrical lines 5 or signal conductors 10 of the further printed circuit board 32 can be contacted by corresponding contact lines 33. Contact can also be made with a ground conductor of the further printed circuit board 32, possibly by at least one contact line 33. The contact lines 33 connect the signal conductors 10 to the contact points 16 of the printed circuit board 3 or to the input-side contacts 9.

In this configuration, in particular on account of the angled design, the problem of different signal propagation times due to the different lengths of the contact lines 33 occurs, and this can prove to have an interfering effect especially when transmitting high-frequency signals. This problem can be solved in a relatively simple manner by using an appropriate electrical circuit or printed circuit board 3.

Owing to the use according to the invention of an electrical circuit, a transition which is suitable in an optimum manner for high-frequency technology can be provided between an input-side interface 30 and an output-side interface 31, wherein differences between the interfaces 30, 31 which would have a negative effect on the signal transmission, such as different line lengths, center-to-center distances or relative positioning of the contacts, geometry or size of the individual contacts and type of material of the individual contacts in particular, can be electrically compensated for or adapted by the appropriately designed electrical circuit.

Figure 11:
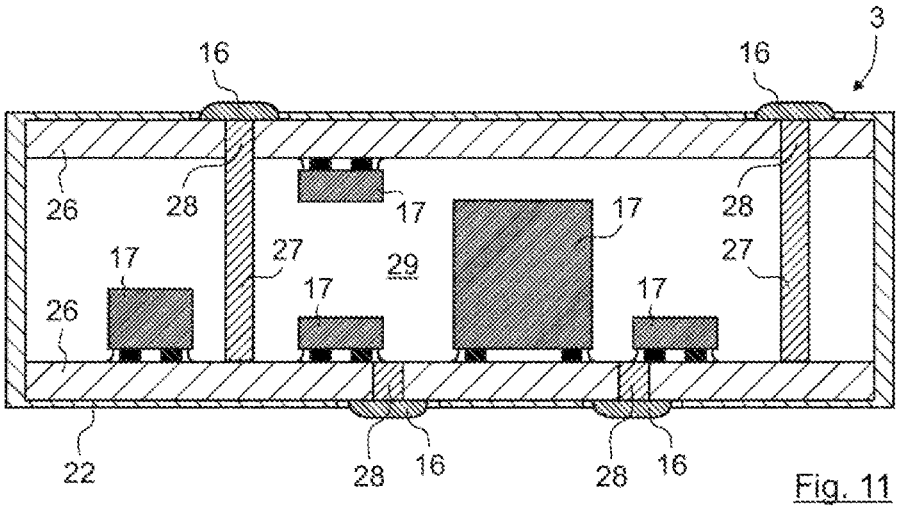
FIG. 11 schematically shows an illustration of a printed circuit board with an encircling metallization and two printed circuit board layers.

FIG. 11 shows a schematic sectional view of a printed circuit board 3 in an optional configuration as a printed circuit board 3, as could be used for the present invention. Said printed circuit board can also be a multilayer printed circuit board.

The printed circuit board 3 according to FIG. 11 comprises, on its surfaces or side faces, a full-surface metallization 22 which is composed of copper and forms the printed circuit board shielding 22. The metallization 22 is cut out around the contact points 16 in order to not short-circuit the contact points 16 onto the shielding.

Two printed circuit board layers 26, which are connected by means of contact-connections 27 and are at a distance from one another, are arranged within the metallization 22. The printed circuit board layers 26 of the printed circuit board 3 are connected to the contact points 16 by means of vias 28. Electrical components 17 are preferably arranged on the inwardly directed sides of the printed circuit board layers 26 in each case. The vias 28 and contact-connections 27 can also be formed in one piece.

A thermally conductive layer 29 can be formed between the printed circuit board layers 26 and the electrical components 17 in a surrounding or immediately adjacent or adjoining manner.

The distance between the printed circuit board layers 26 can be dependent, amongst other things, on the height and/or operating voltage of the electrical components 17 and also on the electrical insulation capacity of the thermally conductive layer 29.

In order to ensure adequate electrical insulation of the thermally conductive layer 29, the thermally conductive layer 29 can contain epoxy resin. On account of the low thermal conductivity of epoxy resin, the thermally conductive layer 29 can additionally be enriched with boron nitride and/or aluminum oxide. Accordingly, the required thickness of the thermally conductive layer 29 can depend largely on the composition of said thermally conductive layer.

Accordingly, synthetic resin can also be used instead of epoxy resin. This is likewise particularly suitable.

A plug-in connector 2 of the embodiments described above of FIGS. 1, 2 and 4 to 10 can also be of two-part design in principle.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. A plug-in connector system comprising:

an electrical circuit and an electrical plug-in connector which is mechanically and electrically connectable to at least one electrical line, wherein the electrical plug-in connector includes (a) at least one input-side contact which can be electrically connected to a signal conductor of the electrical line, (b) at least one output-side contact which can be electrically connected to a plug-in connector internal conductor, (c) shielding means which can be electrically connected to a ground conductor of the at least one electrical line, (d) a receptacle for the electrical circuit, and (e) a closure element for closing an access opening of the receptacle, and wherein the electrical circuit includes contact points which contact-connect the at least one input-side contact and the at least one output-side contact when the electrical circuit is inserted into the receptacle, and wherein the electrical circuit has a transmission option from the at least one input-side contact to the at least one output-side contact, and wherein the closure element is at least partially formed of an electrically conductive material, and wherein the closure element makes electrical contact with the shielding means when the closure element closes the access opening of the receptacle.

2. A plug-in connector system as claimed in claim 1, wherein the electrical circuit comprises at least one of: (i) a two-sided printed circuit board, (ii) a multilayer printed circuit board with more than two printed circuit board layers, (iii) a multichip module, (iv) a system-in-package, (v) a system-on-chip, and (vi) an integrated circuit.

3. A plug-in connector system as claimed in claim 1, wherein the electrical circuit is positioned between the at least one input-side contact and the at least one output-side contact when the electrical circuit is inserted into the receptacle.

4. A plug-in connector system as claimed in claim 1, wherein at least one of: (i) the contact points of the electrical circuit and (ii) the contacts of the plug-in connector comprise at least one of: (a) flat contacts, and (b) sliding contacts, and (c) solder areas, and (d) spring contacts, and (e) plug-in contacts.

5. A plug-in connector system as claimed in claim 1, wherein the input-side contact and the output side contact of the plug-in connector comprise spring contacts which make contact with one another even when the electrical circuit is not inserted into the receptacle.

6. A plug-in connector system as claimed in claim 1, wherein the closure element has at least one contact spring which makes electrical contact with the shielding means of the plug-in connector when the closure element closes the access opening of the receptacle.

7. A plug-in connector system as claimed in claim 1, wherein the closure element is composed of plastic with an electrically conductive attachment or of metal.

8. A plug-in connector system as claimed in claim 1, wherein the closure element has a seal for sealing off the access opening.

9. A plug-in connector system as claimed in claim 1, wherein the closure element can be fixed in a force-fitting and/or materially bonded and/or interlocking manner, preferably clamped and/or screwed and/or adhesively bonded and/or soldered, in a housing of the plug-in connector and/or in the shielding means for the plug-in connector and/or in the receptacle.

10. A plug-in connector system as claimed in claim 1, wherein, the electrical circuit has a circuit shielding, and at least one contact element is provided on the shielding means for the plug-in connector and/or on the ground conductor of the at least one electrical line and/or on the closure element and/or on the electrical circuit, the at least one contact element electrically contact-connecting the circuit shielding to the ground conductor of the at least one electrical line when the electrical circuit is inserted into the receptacle.

11. A plug-in connector system as claimed in claim 1 wherein, the electrical circuit comprises a printed circuit board and at least one electrical component is integrated into the printed circuit board, and wherein a thermally conductive layer is present immediately adjacent at least one of the electrical components, and wherein the thermally conductive layer comprises an electrically insulating polymer carrier material.

12. A plug-in connector system as claimed in claim 1 wherein, the electrical circuit has an input-side interface with at least one input-side contact point which connects to the signal conductor of the at least one electrical line, and wherein the electrical circuit has an output-side interface with at least one output-side contact point, wherein the transmission option provides impedance control between the input-side interface and the output-side interface, and wherein the input-side interface has a configuration which differs from a configuration of the output-side interface.

13. A plug-in connector system as claimed in claim 11 wherein, the electrically insulating polymer carrier material comprises a resin.

14. A plug-in connector system as claimed in claim 13 wherein, the resin comprises at least one of, a synthetic resin and an epoxy resin.

15. A plug-in connector system as claimed in claim 11 wherein, the thermally conductive layer further comprises at least one of, aluminum oxide and boron nitride.

* * * * *